US011964815B2

(12) United States Patent
Kresse et al.

(10) Patent No.: US 11,964,815 B2
(45) Date of Patent: Apr. 23, 2024

(54) SELF-FUNNELING FLEXIBLE CONTAINER

(71) Applicant: Halliburton Energy Services, Inc., Houston, TX (US)

(72) Inventors: Frank Kresse, Duncan, OK (US); Calvin L. Stegemoeller, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 545 days.

(21) Appl. No.: 17/275,989

(22) PCT Filed: Oct. 25, 2018

(86) PCT No.: PCT/US2018/057492
§ 371 (c)(1),
(2) Date: Mar. 12, 2021

(87) PCT Pub. No.: WO2020/086084
PCT Pub. Date: Apr. 30, 2020

(65) Prior Publication Data

US 2021/0284435 A1 Sep. 16, 2021

(51) Int. Cl.
*B65D 88/24* (2006.01)
*B65D 88/26* (2006.01)
*B65D 88/54* (2006.01)

(52) U.S. Cl.
CPC ..... *B65D 88/24* (2013.01); *B65D 88/26* (2013.01); *B65D 88/54* (2013.01); *B65D 2588/16* (2013.01); *B65D 2588/54* (2013.01)

(58) Field of Classification Search
CPC ..... B65D 88/24; B65D 88/26; B65D 88/54; B65D 2588/16; B65D 2588/54
(Continued)

(56) References Cited

U.S. PATENT DOCUMENTS 2,222,083 A 11/1940 Lintz
5,690,253 A 11/1997 LaFleur
(Continued)

FOREIGN PATENT DOCUMENTS

DE 4308473 A1 * 9/1994 ..... B65D 90/205
DE 202008010682 U1 * 11/2008 ..... B65D 88/26
(Continued)

OTHER PUBLICATIONS

Machine translation of KR-101834732-B1.*
(Continued)

*Primary Examiner* — Jes F Pascua
(74) *Attorney, Agent, or Firm* — Conley Rose, P.C.; Rodney B. Carroll

(57) ABSTRACT

A self-funneling flexible container may be used with a storage and transportation system to provide an efficient, effective and cost-efficient transfer of material to, from or about a site, for example, a hydrocarbon exploration, recovery, production or operation site. The self-funneling flexible container may comprise one or more bands about the bottom or the bottom and one or more sides of the self-funneling flexible container. The bands have an elasticity such that the weight of material disposed in the self-funneling flexible container transitions the bands to an expanded position. When the material is discharged, the bands transition to a contracted position to form a funnel or chute so that all material may be efficiently discharged. As the funnel or chute is only formed at discharge, the self-funneling flexible container may store more material than traditional rigid containers.

20 Claims, 8 Drawing Sheets

(58) Field of Classification Search
USPC ..... 383/6, 43, 67
See application file for complete search history.

(56) References Cited

U.S. PATENT DOCUMENTS

| | | | |
|---|---|---|---|
| 6,048,296 | A | 4/2000 | Futerman |
| 6,955,273 | B2 | 10/2005 | Hartwall |
| 2015/0086307 | A1 | 3/2015 | Stefan |
| 2018/0201437 | A1 | 7/2018 | Surjaatmadja et al. |

FOREIGN PATENT DOCUMENTS

| | | | | |
|---|---|---|---|---|
| FR | 2579561 | A1 | 10/1986 | |
| JP | 2003-312776 | A | 11/2003 | |
| KR | 20-0370654 | Y1 | 12/2004 | |
| KR | 101834732 | B1 * | 3/2018 | |
| WO | 2012/058059 | A1 | 5/2012 | |
| WO | WO-2013192402 | A1 * | 12/2013 | ..... B65B 69/0008 |

OTHER PUBLICATIONS

Machine translation of DE-4308473-A1.*
International Search Report and Written Opinion issued in related PCT Application No. PCT/US2018/057492 dated Jul. 24, 2019, 14 pages.

* cited by examiner

SELF-FUNNELING FLEXIBLE CONTAINER

CROSS-REFERENCE TO RELATED APPLICATION

The present application is a U.S. National Stage Application of International Application No. PCT/US2018/057492 filed Oct. 25, 2018, which is incorporated herein by reference in its entirety for all purposes.

TECHNICAL FIELD

The present disclosure relates generally to transport and discharge of materials using a container, and more particularly, to a configuration of a soft-side or flexible container for transporting materials to and discharge of materials at a site.

BACKGROUND

During the drilling and completion of hydrocarbon wells such as oil and gas wells, various wellbore treating fluids or other materials are used for any number of purposes or operations. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing and stimulation operations. The high viscosity fluids are normally produced by mixing dry powder and/or granular materials and agents with water at the well site as they are needed for a particular treatment. Systems for metering and mixing the various materials are normally portable, for example, skid- or truck-mounted, since they are needed for only short periods of time at a well site.

Materials required at a site are normally or generally transported to a site using a container in or on a transport unit or vehicle including but not limited to a commercial or common carrier tank truck, train, container on a trailer, a railcar or any other type of transport unit. Once the transport unit or vehicle with the container is at the site, the material (for example, bulk material) must be transferred or conveyed from the transport unit or vehicle into a blender or a supply tank for metering into a blender as needed. Traditionally, a storage or transport container is rigid with a height and weight making the container cumbersome or difficult to move about a site. For example, the exterior sides of the container may be at right angles even though the interior of the container forms a funnel or slope to provide for the flow or discharge of the material from the container. For a container that comprises a funnel to store the same amount of a material as generally rectangular container stores, the height of the container must be increased to account for space that is not utilized due to the interior funnel shape of the container. Increasing the height of a container may prevent the container from being transported on certain transportation units or on certain transportation pathways. Increasing the height of the container also increases the overall weight of the container. As transportation units and pathways generally have weight and/or height restrictions, an increase in the weight of container generally translates to less material that can be transported. A cost-effective, efficient and compact container is required to address the transportation, weight and cost issues associated with present systems.

Providing a more robust and efficient material transfer configuration is required to address the safety, productivity, environmental and cost issues associated with the present systems.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
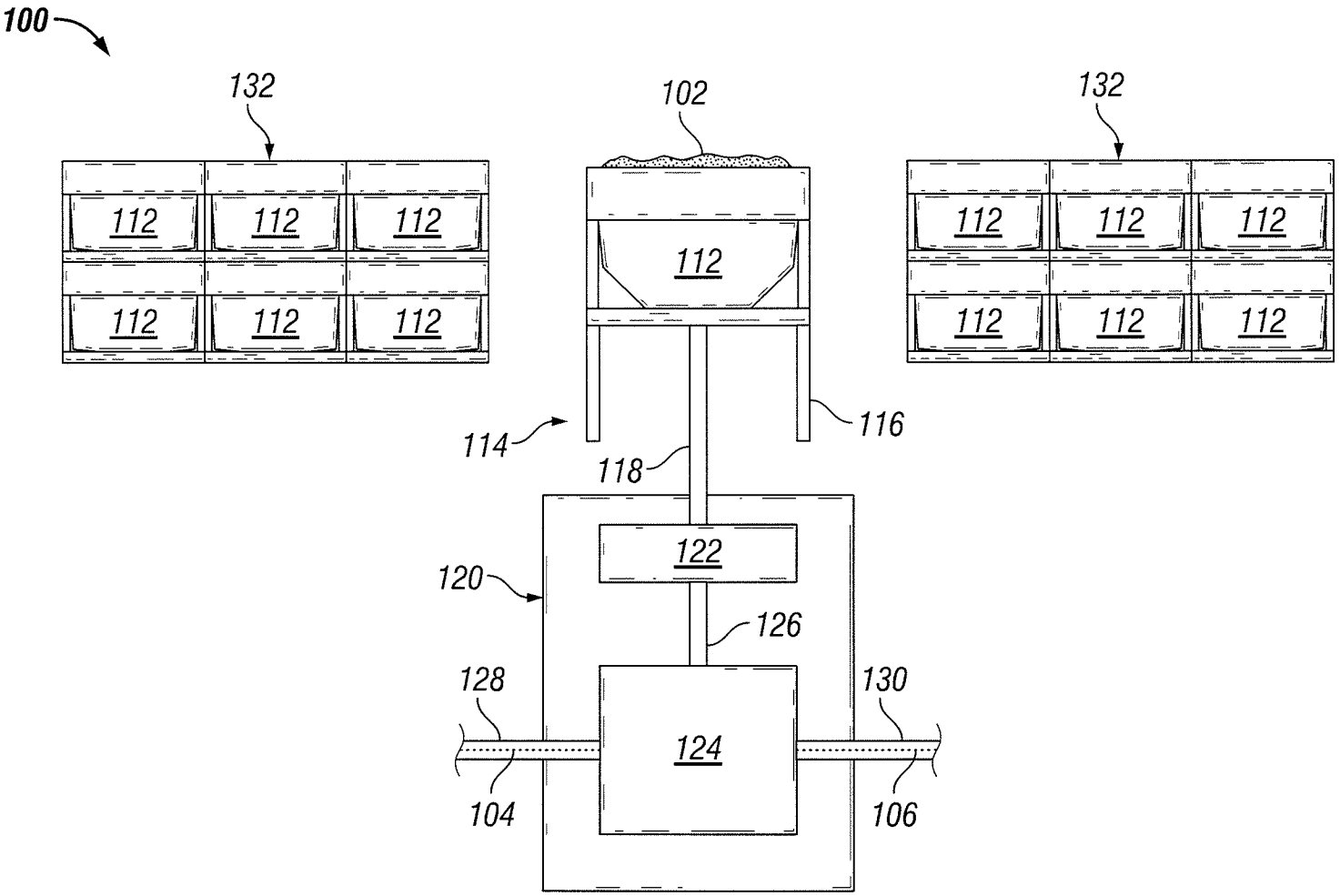
FIG. 1 is a block diagram of a self-funneling flexible container for transferring material to a blender system, according to one or more aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Throughout this disclosure, a reference numeral followed by an alphabetical character refers to a specific instance of an element and the reference numeral alone refers to the element generically or collectively. Thus, as an example (not shown in the drawings), widget "1A" refers to an instance of a widget class, which may be referred to collectively as widgets "1" and any one of which may be referred to generically as a widget "1". In the figures and the description, like numerals are intended to represent like elements.

Certain embodiments according to the present disclosure may be directed to systems and methods for efficiently managing transport and transfer of material or bulk material (for example, solid or mostly solid with liquid material). Material handling systems are used in a wide variety of contexts including, but not limited to, drilling and completion of hydrocarbon wells (for example, oil and gas wells), concrete mixing applications, agriculture and others. The disclosed embodiments are directed to systems and methods for safe, compact, efficient and cost-effective transfer of material to a job site or a hydrocarbon, well services or operation site, from a job site or a hydrocarbon, well services or operation site to a desired destination at, for example, to a blender, storage system or material handling system or both.

Existing container systems used to transport and store materials, including, but not limited to, bulk materials (for example, sand, proppant, plugging agents, gel particulate, or dry-gel particulate) that are used during the formation of treatment fluids, for example, for a stimulation operation, perforation operation or a plug operation are generally rigid. The material must not only be transported to a site but also transferred between transportation units, storage tanks, blenders, and other on-site components so that the material can be discharged as required by a given operation. As conventional containers are rigid, the containers maintain a specific or non-flexible shape which generally comprises a funnel-shaped interior so that the material discharged may be metered and completely exhausted from the container. As the container has a funnel-shaped interior, the height of the container is increased to compensate for the loss of material storage area. As the height of the container increases use of certain transportation units and pathways may not be utilizable. For example, conventional containers may require that the transportation unit comprise a double dropneck trailer whereas the present disclosure contemplates a container transportable by a standard flatbed trailer.

The self-funneling flexible container disclosed herein eliminates the shortcomings associated with existing rigid containers for materials or bulk materials. The height of the container is minimized as the self-funneling flexible containers may store material in an expanded position and discharging material while transitioning to or in a contracted position. Personnel, costs, operation time and machinery or equipment requirements may be reduced as the self-funneling flexible container stores and transports more material while having a lower and more stable height than existing rigid containers.

In one or more embodiments, one or more self-funneling flexible container systems may include a band configuration that allows the flexible outer surface of the container to transition to an expanded position due to the weight of the material and to transition to a contracted position as the material is discharged from the container. In this way, the container may store or transport more material by weight as a conventional container at a lower container height as space is not required to form a funnel or sloped surface on the interior of the container. The present disclosure provides a self-funneling flexible container system to efficiently and cost-effectively handle conveyance (including but not limited to transport, transfer, conveyance or discharge) of any desirable material having a solid, solid with a liquid constituency, any other material or substance conveyable via a self-funneling flexible container system, or any combination thereof including, but not limited to, any one or more of water, cement, cement powder, sand, proppant, gel particulate, diverting agent, stimulation fluid, slurry, mud, mortar, concrete, dry-gel particulate, liquid additives, any other material or combination thereof from one location to any desired destination or location at a site. Costs for conveyance of the material may be decreased as more material can be conveyed as the weight of the container is reduced given that the overall height of the container may be shortened as no funnel-shaped interior is required for discharge of the material. Additionally, material may be conveyed or transported on transportation pathways that may otherwise be unavailable to conventional containers, for example, due to height restrictions for certain transportation pathways. Additionally, safety is increased given the shortened height of the self-funneling flexible containers which allows for ease of balancing and also reduces the storage height as well as the height for placement for discharge of materials. In general, a lower height that a container must be raised to and lowered from increases safety. Further, as the self-funneling flexible containers may have a shortened height compared to conventional containers, the self-funneling flexible containers may be easily maneuvered to various locations or positions at a site.

Turning now to the drawings, FIG. 1 is a block diagram of a material handling system 100 illustrating one or more self-funneling flexible containers 112 at, for example, a hydrocarbon recovery, exploration or production site, such as oil, well services or operations site, according to one or more aspects of the present disclosure. While FIG. 1 illustrates one or more self-funneling flexible containers 112 vertically stacked, the present disclosure contemplates any placement or disposition of one or more self-funneling flexible containers 112. The one or more self-funneling flexible containers 112 may be elevated or otherwise supported by a support structure 114. Any one or more self-funneling containers 112 may comprise a material 102, for example, a solid, a solid with a liquid, a liquid material, any other material or substance or any combination thereof. In one or more embodiments, the material 102 comprises a stimulation fluid. In one or more embodiments, support structure 114 may be portable. The portable support structure 114 may include a frame 116 for receiving and holding the self-funneling flexible container 112 and a gravity-feed outlet 118 for directing or discharging material 102 away from the self-funneling flexible container 112. The outlet 118 may be coupled to and extended from the frame 116. The outlet 118 may utilize a gravity feed to provide a controlled, for example, a metered flow of material 102 from the self-funneling flexible container 112 to a blender unit 120.

The blender unit 120 may include a hopper 122 and a mixer 124 (for example, mixing compartment). The blender unit 120 may also include a metering mechanism 126 for providing a controlled, for example, metered, flow of the material 101 to the mixer 124. In one or more embodiments, the blender unit 120 may not include the hopper 122 such that the outlet 118 of the support structure 114 may provide material 102 directly to the mixer 124.

An additional fluid or additive 104, for example, water, any other solid, liquid or other additive or material may be supplied to the mixer 124 (for example, mixing compartment) through an inlet flow line 128. In one or more embodiments, more than one inlet flow lines 128 may be coupled to the mixer 124 such that one or more additives 104 may be flowed to the mixer 124. The material 102 and the additive 104 may be mixed in mixer 124 to produce an output fluid 106, for example, a stimulation fluid, a mixture combining multiple types of proppant, proppant/dry-gel particulate mixture, sand/sand-diverting agents mixture, cement slurry, drilling mud, a mortar or concrete mixture, or any other fluid mixture for use at a site. The output fluid 106 may be flowed from the mixer 124 via one or more outlet flow lines 130. The outlet flow line 130 may be coupled to a pump for conveying the output fluid 106 to a desired location, for example, a hydrocarbon recovery well or wellhead. In one or more embodiments, the system 100 may be utilized in any number of operations including, but not limited to, a stimulation operation, agricultural application to dispense grain, feed, seed or any other mixture, substance or material and any other operation that requires storage and discharge of a material.

Self-funneling flexible container 112 may be elevated above an outlet location via the frame 116. The support structure 114 may be designed to elevate the self-funneling flexible container 112 above the level of a blender inlet, for example, blender hopper 122, mixing tub 124 or both, to allow the material 102 to gravity feed from the self-funneling flexible container 112 to the blender unit 120. As the self-funneling flexible container 112 is supported by frame 116, the material 102 may be discharged directly into the blender unit 120 via the gravity feed outlet 118 of the support structure 114.

While FIG. 1 illustrates frame 116 supporting a single self-funneling flexible container 112, in one or more embodiments, frame 116 may be configured to support any number of self-funneling flexible containers 112. In one or more embodiments, the frame 116 may be a skid, a pallet, a trailer, a railcar, a boxcar, a barge, or any other transportation unit. In one or more embodiments, any one or more self-funneling flexible containers 112 may be completely separable and transportable from the frame 116 such that any one or more flexible and self-funneling containers 112 may be selectively removed from the frame 116 and replaced with another self-funneling flexible container 112. For example, during discharge once material 102 from the self-funneling flexible container 112 reaches a threshold or otherwise empties, a new self-funneling flexible container 112 may be placed on the frame 116 to maintain a steady flow of material 102. In one or more embodiments, the self-funneling flexible container 112 may be closed before being completely emptied, removed from the frame 116 and replaced by a self-funneling flexible container 112 holding a different type of material 102.

Figure 2:
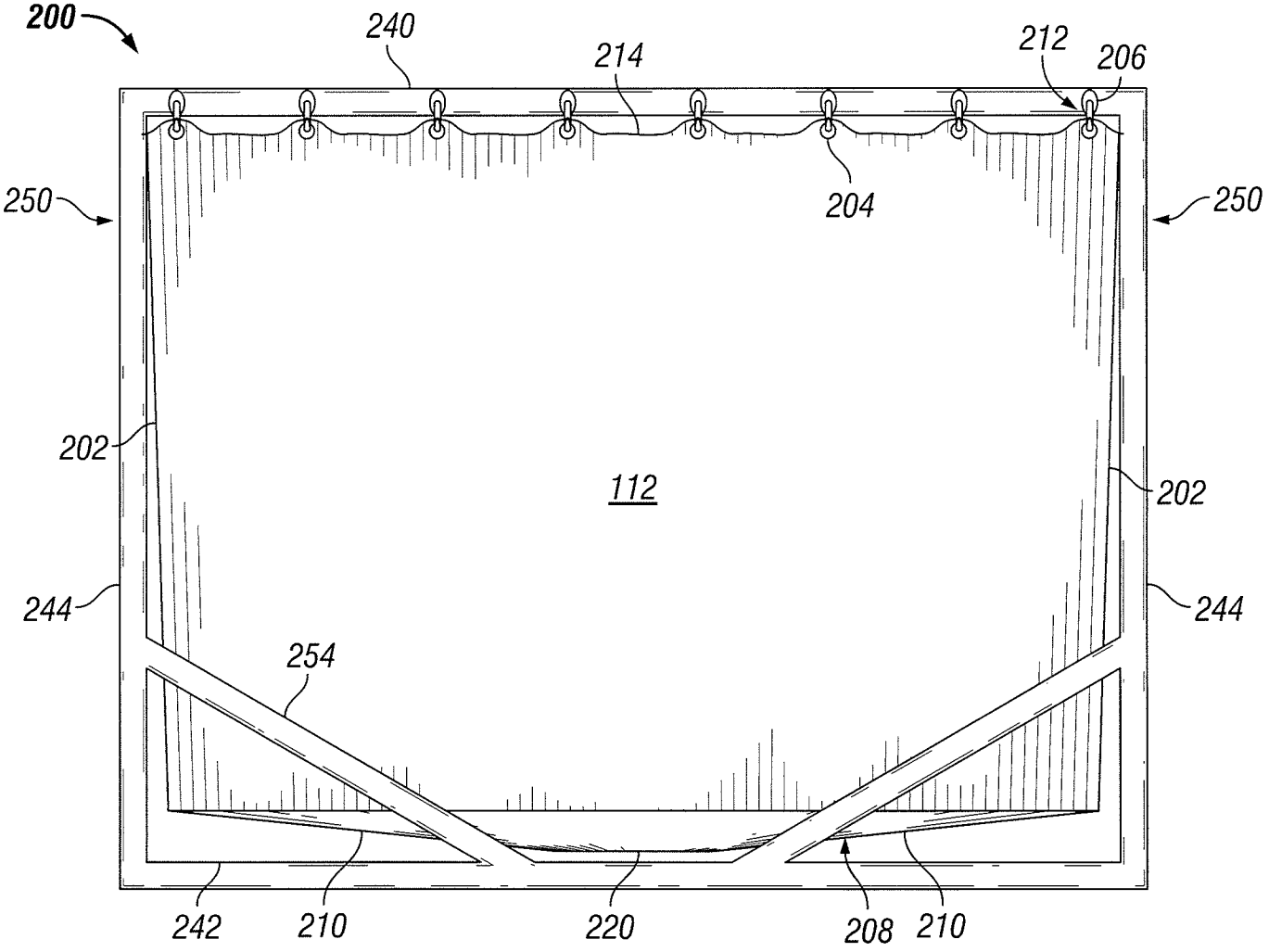
FIG. 2 is a side-view of a self-funneling flexible container system, according to one or more aspects of the present disclosure.

FIG. 2 illustrates a side-view of a self-funneling flexible container system 200, according to one or more aspects of the present disclosure. Self-funneling flexible container system 200 may comprise a frame 250 that supports a self-funneling flexible container 112. The frame 250 may be similar to frame 116 of FIG. 1. In one or more embodiments, frame 250 may comprise a top support 240, a bottom support 242 and a plurality of side supports 244. One or more braces 254 may couple to the side supports 244 to the bottom support 242 to provide additional structural support for the frame 250. In one or more embodiments, frame 250 comprises a support structure, for example, support structure 410 of FIG. 4A. For example, frame 250 may comprise only a top portion 214 with the self-funneling flexible container 112 suspended from the top portion 214. When a self-funneling flexible container 112 is filled with a material, for example, material 102 of FIG. 1, the weight or force of the material 102 may maintain a shape of or provide support for any one or more sides 202, bottom 208 or both without a frame 250 or frame 116. In one or more embodiments, the frame 250 or frame 116 may be integral with the self-funneling flexible container.

Self-funneling flexible container 112 may comprise a flexible or pliable type of substance or material that is conformable to the material to be stored or discharged, for example, material 102, stored or otherwise deposited into the container 112. For example, self-funneling flexible container 112 may comprise fabric, plastic, nylon, rubber, leather, metal, a woven material, any other composition or any combination thereof. Self-funneling flexible container 112 is illustrated in FIG. 2 in an expanded position such that the material 102 in self-funneling flexible container 112 has filled or has a weight sufficient to apply a force to each side 202 and bottom 208 of the self-funneling flexible container 112. In one or more embodiments, a top portion 214 of the self-funneling flexible container 112 may slide, be tied or otherwise be inserted into a groove of the top support 240. In one or more embodiments, the frame 250 may be integral to or with the self-funneling flexible container 112.

The bottom 208 of self-funneling flexible container 112 may comprise a gate or flap 220 from which material 102 may be released, discharged or otherwise emptied from the self-funneling flexible container 112 and one or more expandable portions 210. The gate 220 may comprise a metering gate that meters the discharge of material 102 from the self-funneling flexible container 112.

The one or more expandable portions 210 may comprise one or more bands (discussed below with respect to FIGS. 6-9) that pull or otherwise transition the one or more expandable portions 210 from and expandable position to a contracted position as material 102 is discharged or otherwise removed from the self-funneling flexible container 112 such that the one or more expandable portions 210 form a funnel shape to propagate flow of the materials 102. The one or more expandable portions 210 may be disposed or positioned about the bottom 208, the bottom 208 and at least a portion of one or more sides 202, or any other location or position.

The self-funneling flexible container 112 may couple to or otherwise be supported by the frame 250 using any one or more fastener assemblies 212. For example, one or more grommets 204 may be disposed or otherwise positioned about the top side or portion 204 of the self-funneling flexible container 112. For example, the grommets may be distributed, aligned or otherwise positioned across the top side or portion 204. In one or more embodiments, grommets 204 may comprise a hole or aperture, eyelet, seamed opening, any other grommet or opening or any combination thereof. One or more holders 206 distributed, aligned or otherwise positioned or disposed across the top support 240 may be coupled to the grommets 204. In one or more embodiments, holders 206 may comprise a hook, a fastener, a clip, a ring, any other fastening device, or combinations thereof.

Figure 3:
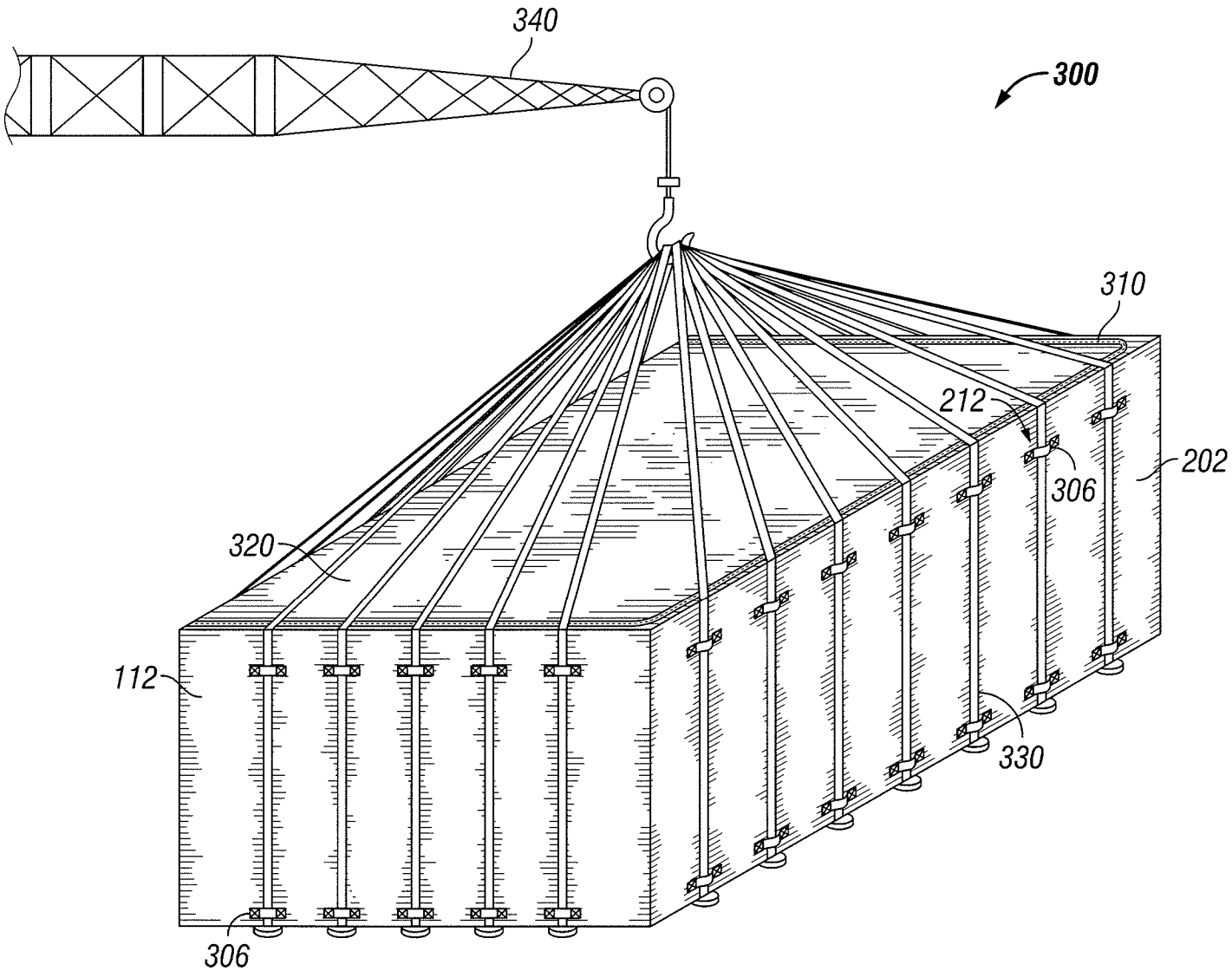
FIG. 3 is an isometric-view of a self-funneling flexible container system, according to one or more aspects of the present disclosure.

FIG. 3 is an isometric-view of a self-funneling flexible container system 300, according to one or more aspects of the present disclosure. The self-funneling flexible container system 300 may comprise a self-funneling flexible container 112. One or more fasteners 212 may be coupled or adhered to, disposed or positioned about, or otherwise secured to the self-funneling flexible container 112, for example, by one or more buckles 306. In one or more embodiments, the one or more fasteners 212 may comprise one or more grommets 204 and one or more holders 206 as illustrated in FIG. 2, a ratchet, seam, any other device or assembly that secures the one or more straps 330 to the self-funneling flexible container 112 to support the self-funneling flexible container 112 and to provide support for lifting the self-funneling flexible container 112. In one or more embodiments, the straps 330 may be sewn, glued or otherwise adhered or secured to the self-funneling flexible container 112. The one or more straps 330 may be positioned or disposed about the self-funneling flexible container 112 such that the one or more straps 330 extend from one side 202 along the bottom 208 to an opposite side 202 so as to circumnavigate the self-funneling flexible container 112. The one or more straps 330 may be separated from each other by any distance. While FIG. 3 illustrates the one or more straps 330 in a parallel configuration, the present disclosure contemplates any configuration for supporting and transporting the self-funneling flexible container 112. In one or more embodiments, the one or more straps 330 may be gathered above the self-funneling flexible container 112 or the top cover 320 to aid in lifting or otherwise transporting the self-funneling flexible container 112. For example, the one or more straps 330 may gather at a central point or be disposed about a hoisting mechanism 340. In one or more embodiments, the one or more straps 330 may couple to a frame 116 of FIG. 2, a support structure 410 of FIG. 4A, any other structure or frame, or any combination thereof, for example, using one or more fasteners 212, any other fastener or combination thereof.

In one or more embodiments, the top cover 320 covers all or a portion of the top side or portion 214 of the self-funneling flexible container 112. The top cover 320 may be coupled, engaged, secured, attached, or otherwise adhered to the side 202 or outer circumference of the self-funneling flexible container 112 by a fastener 310. Fastener 310 may comprise a zipper, a hook and eye, hook and loop, a hinge, string ties, stitching, adhesive, any other fastener or combination thereof. The top cover 320 may provide additional support and may prevent contamination of the surrounding environment by loose particles falling into or out of the self-funneling flexible container 112. In one or more embodiments, the top cover 320 may extend over any side 202.

Figures 4A, 4B:
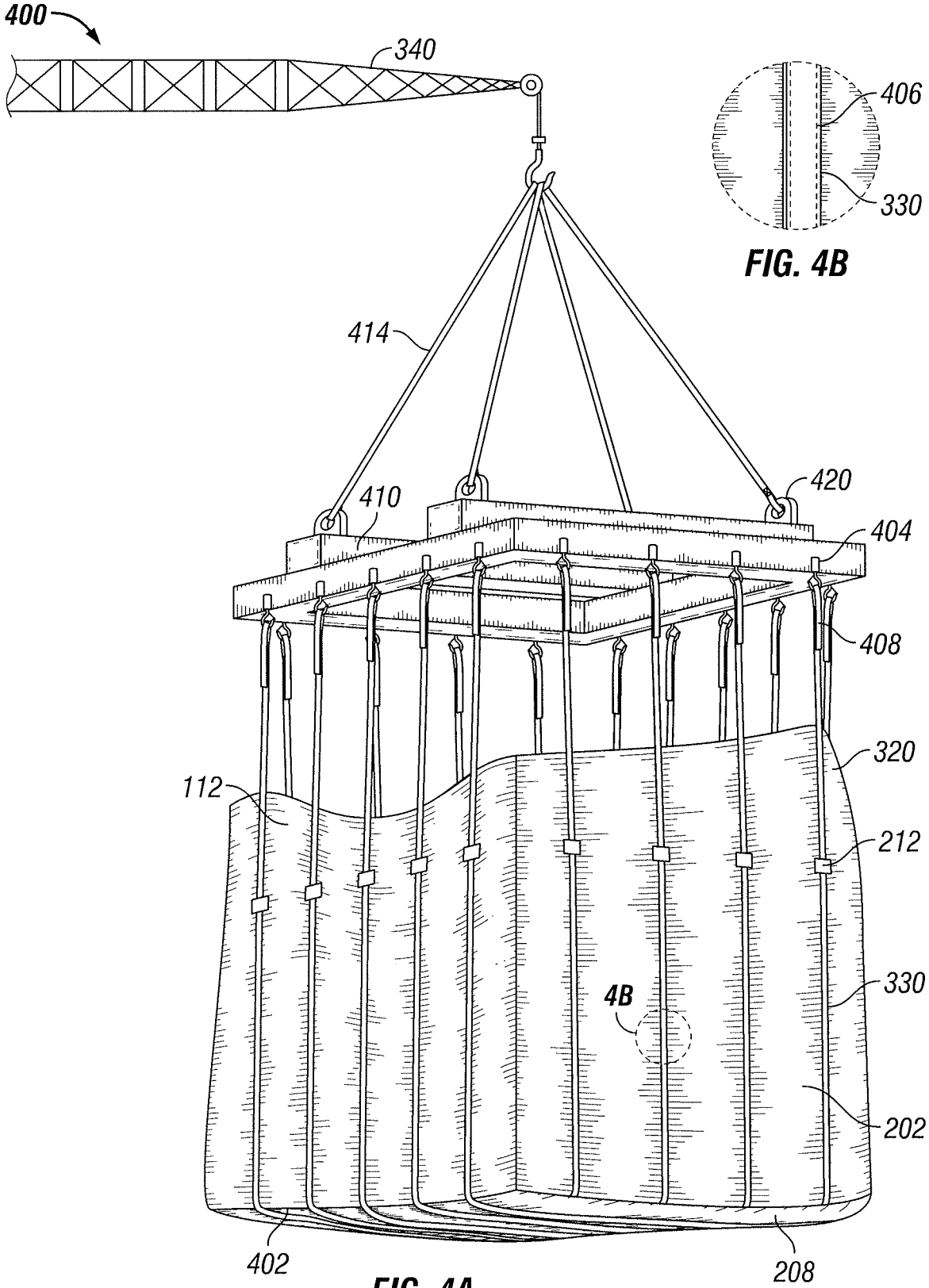
FIG. 4A is an isometric view of a self-funneling flexible container system, according to one or more aspects of the present disclosure.
FIG. 4B is a magnified view of a strap and seam of a self-funneling flexible container system, according to one or more aspects of the present disclosure.

FIG. 4A is an isometric view of a self-funneling flexible container system 400, according to one or more embodiments of the present disclosure. The self-funneling flexible container system 400 comprises a self-funneling flexible container 112 and a support structure 410. The self-funneling flexible container 112 may comprise a fabric, plastic, nylon, leather, metal, a woven material, any other composition or any combination thereof. The self-funneling flexible container 112 may comprise a single piece of material or may comprises a plurality of pieces of material, for example, one or more seams 402 may be coupled, adhered, secured or otherwise attached to one or more sides 202 together or one or more sides 202 to bottom 208.

In one or more embodiments, the self-funneling flexible container 112 comprises one or more straps 330 that circumnavigate or are otherwise secured or fastened to the self-funneling flexible container 112. The one or more straps 330 may be secured to the self-funneling flexible container 112 by one or more fasteners 212, by stitching or a seam 406, glue or adhesive, any other type of fastener or any combination thereof. For example, as illustrated in FIG. 4B, a seam 406 may secure a strap 330 to the self-funneling flexible container 112. In one or-more embodiments, any one or more straps 330 may be secured to an outer or interior surface or within one or-more sides 202.

The self-funneling flexible container 112 may be supported or transported by a support structure 410. Support structure 410 may comprise one or more lifting connectors 420. The one or more lifting connectors 420 may be positioned or disposed about the support structure 410. In one or more embodiments, the one or more lifting connectors 420 are disposed or positioned at two diagonal ends of the support structure 410, at or about each side of the support structure 410, in the middle of the support structure 410 any other location or position or any combination thereof. In one or more embodiments, the support structure 410 is a frame that supports the self-funneling flexible container 112. In one or more embodiments, the support structure 410 may be similar to frame 116 of FIG. 1 or may couple to a frame 116. The one or more lifting connectors 420 may allow the support structure 410 to couple to cabling 414 or other structures that allow a hoisting mechanism 340 to lift, lower, move, transport, displace or otherwise dispose or position the self-funneling flexible container 112. The hoisting mechanism may comprise a crane, a forklift, winch, pulley system, any other hoisting mechanism or any combination thereof. The support structure 410 may comprise one or more fasteners 404 for coupling the support structure 410 to the one or more straps 330. In one or more embodiments, the one or more fasteners 404 may comprise a carabiner that clips or secures a loop 408. The one or more fasteners 404 may be disposed or positioned about the support structure in any configuration that provides support for the self-funneling flexible container 112.

Figure 5:
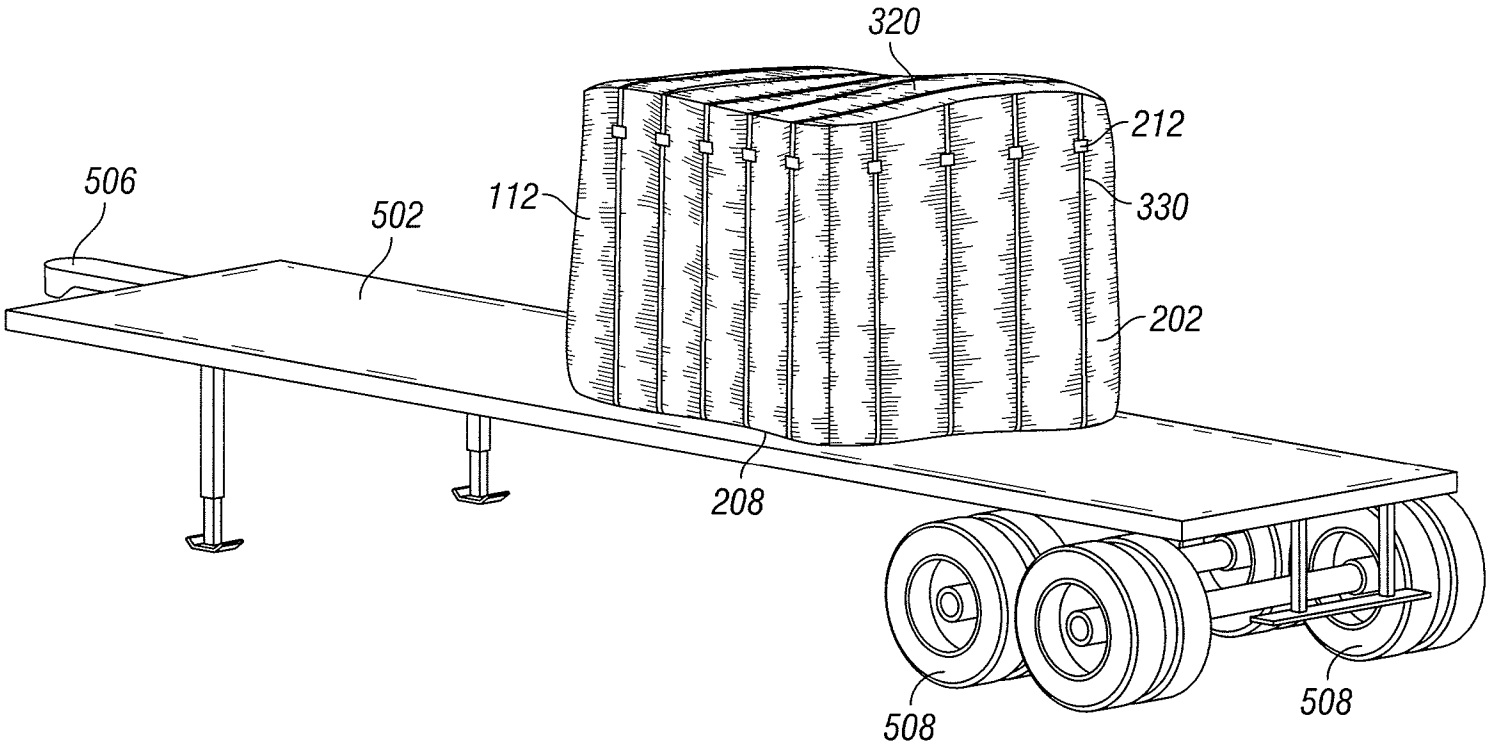
FIG. 5 is a block diagram of a self-funneling flexible container system, according to one or more aspects of the present disclosure.

FIG. 5 illustrates a block diagram of a self-funneling flexible container system 500, according to one or more aspects of the present disclosure. One or more self-funneling flexible containers 112 may be positioned or disposed on a trailer 502. The trailer 502 may be any type of support structure or transportation unit. In one or more embodiments, a self-funneling flexible container 112 may be supported by a frame 116 of FIG. 1 or a frame 250 of FIG. 2. The trailer 502 may comprise a hitch 506 to couple or engage the trailer 502 with another transportation unit or transportation vehicle and a plurality of wheels 508 for ease of mobility along a transportation pathway.

Figure 6:
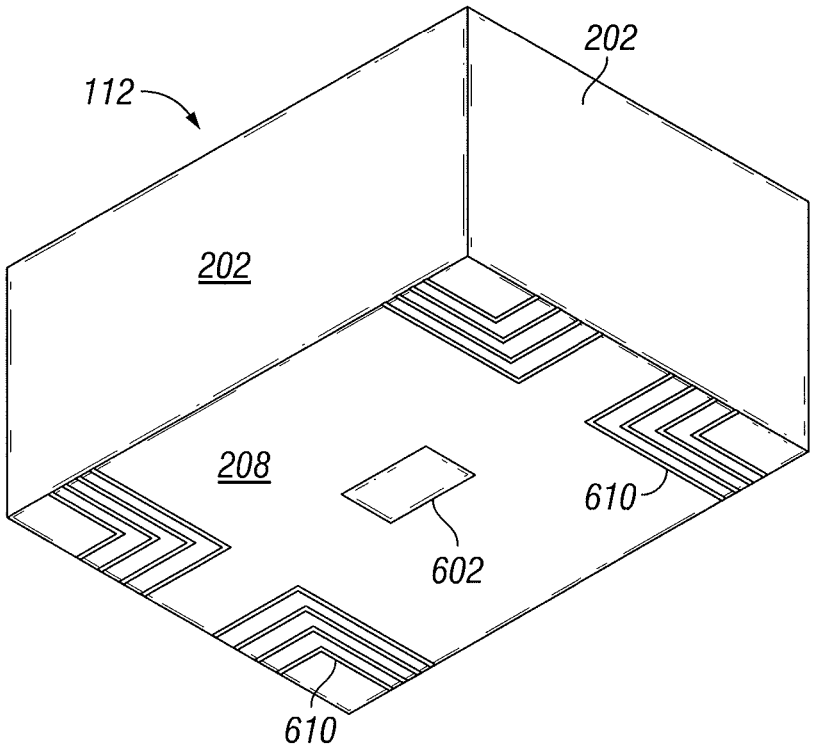
FIG. 6 is an isometric view of a self-funneling flexible container with one or more bands in an extended position, according to one or more aspects of the present disclosure.

FIG. 6 illustrates an isometric view of a self-funneling flexible container 112 with one or more bands 610 in an extended or expanded position, according to one or more aspects of the present disclosure. The self-funneling flexible container 112 may comprise one or more bands 610 disposed or positioned about a bottom 208, one or more sides 202 or both. The present disclosure contemplates that the one or more bands 610 may be disposed or positioned about the bottom 208, any one or more sides 202, the bottom 208 and at least a portion of any one or more sides 202 or any other configuration. The one or more bands 610 comprise an elastic or substantially elastic substance or material including, but not limited to, a spring, a rubber, any other elastic material or combination thereof. Each of the one or more bands 610 has an associated elasticity. The one or more bands 610 transition to an expanded position as illustrated in FIG. 6 when material, fluid or substances are placed into the self-funneling flexible container 112. For example, the one or more bands 610 may extend or expand as material 102 is added to the self-funneling flexible container 112 increases. For example, the expansion of the one or more bands 610 is related to the weight of material 102 in the self-funneling flexible container 112. As the self-funneling flexible container 112 is flexible such that it expands, no space is unusable as each corner is capable of being filled with a material, for example, material 102 of FIG. 1.

The self-funneling flexible container 112 may comprise a gate 602. Gate 602 may be a drawstring mechanism, a flap, a metering device, any other device that can transition between open and closed states such that, for example, a material 102 may be stored in or discharged from the self-funneling flexible container 112.

Figure 7:
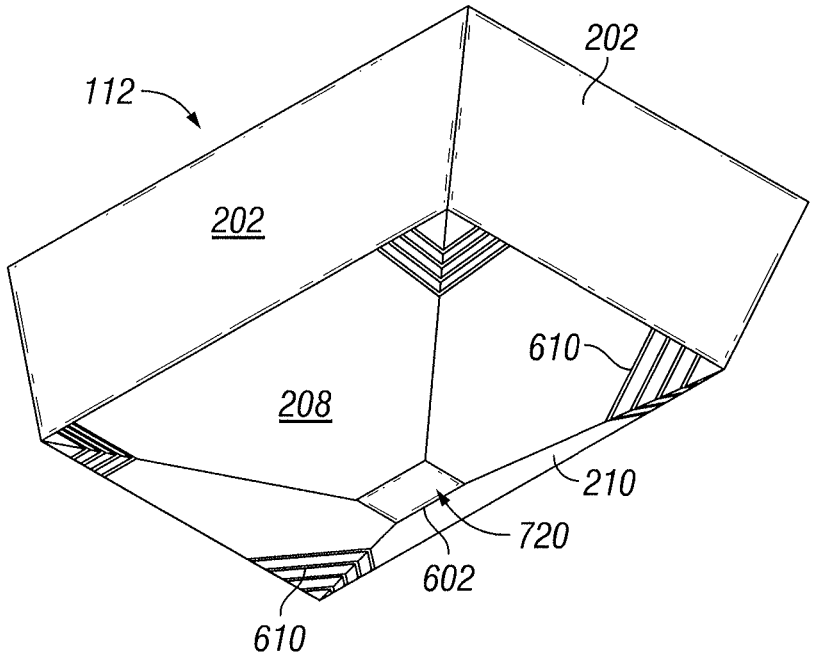
FIG. 7 is an isometric view of a self-funneling flexible container with one or more bands in a contracted position, according to one or more aspects of the present disclosure.

FIG. 7 is an isometric view of a self-funneling flexible container 112 with one or more bands 610 in a contracted position, according to one or more aspects of the present disclosure. As illustrated in FIG. 7, when the one or more bands 610 transition to a contracted position, the bottom 208 contracts to form a chute or funnel so that material such as material 102 stored in the self-funneling flexible container 112 may be discharged. In one or more embodiments, any one or more bands 610 may be disposed or positioned as discussed above with respect to FIG. 6 such that as the one or more bands 610 transition to a contracted position, the one or more sides 202 along with the bottom 208 form a chute or a funnel 720.

Figure 8:
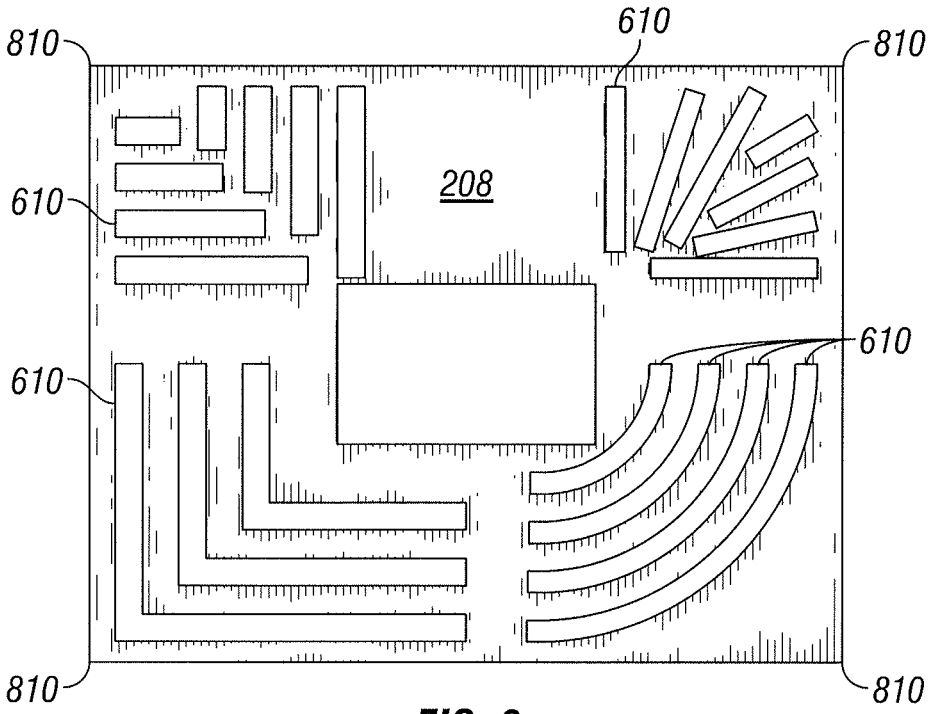
FIG. 8 is a block diagram of band configurations in an extended position, according to one or more aspects of the present disclosure.

FIG. 8 is a block diagram of various band configurations in an extended position. One or more bands 610 may be disposed or positioned about the bottom 208, the bottom 208 and at least a portion of one or more sides 202, one or more sides 202 or any other configuration. The one or more bands 610 may be arranged or configured to form an L-shaped pattern 802, a curved pattern 804, a radiating line pattern 806, an inverted L-shaped pattern 808, any configuration or pattern or any combination thereof. In one or more embodiments, any one or more patterns may be formed by using a plurality of bands as illustrated with respect to pattern 806. That is, a plurality of bands 610 may be configured to form the desired pattern. In one or more embodiments, the one or more bands 610 are disposed in one or more corners 810 of the bottom 208. In one or more embodiments, the one or more bands 610 may extend from any one or more corners 810 to any length along the bottom surface 208, one or more sides 202 or both. For example, any one or more bands 610 may extend from a first corner 810 to a second corner 810 or to any number of corners 810. In one or more embodiments, any one or more bands 610 may circumnavigate the bottom 208. In one or more embodiments, the elasticity of any one or more bands 610 may be consistent throughout the band, vary between each end of the band, vary between any one or more points along the band, comprise any other variation or comprise any one or more combinations thereof.

Figure 9:
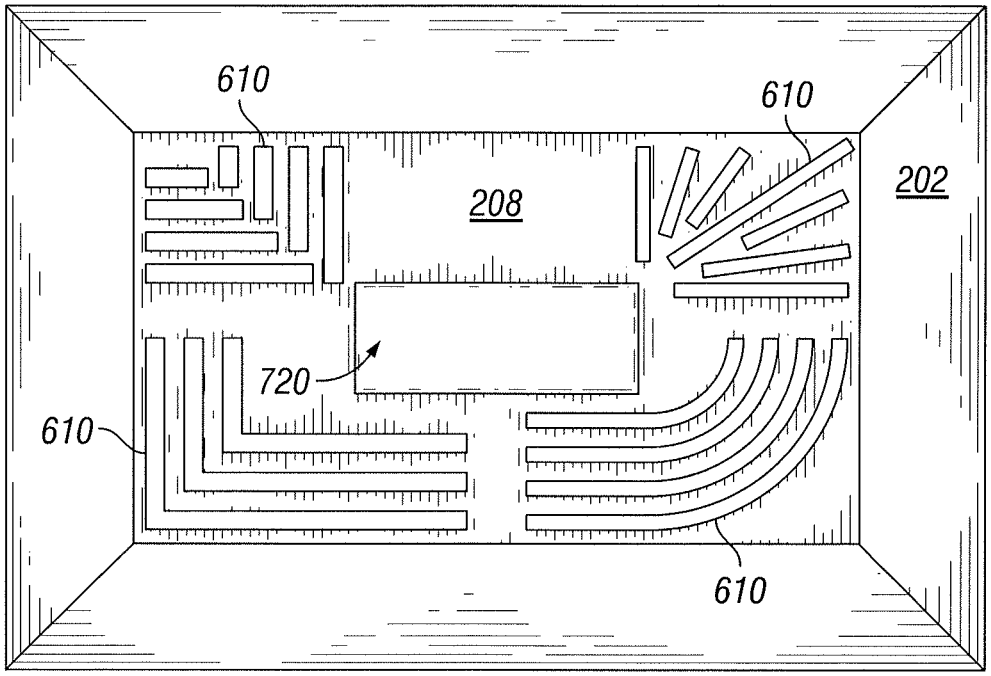
FIG. 9 is a block diagram of a self-funneling flexible container with band configurations in a contracted position, according to one or more aspects of the present disclosure.

FIG. 9 is a block diagram of a self-funneling flexible container 112 with various band configurations in a contracted position, according to one or more aspects of the present disclosure. As the material, for example, material 102 of FIG. 1, is discharged from the self-funneling flexible container 112, the one or more bands 610 transition to a contracted position based, at least in part, on the elasticity of the one or more bands 610. That is, as the weight of the material 102 in the self-funneling decreased the one or more bands 610 transition to a contracted position. As the elasticity of the one or more bands 610 causes the one or more bands 610 transition to a contracted position when material 102 is discharged, the bottom 208 or the bottom 208 and the sides 202 form a chute or funnel 720. In one or more embodiments, the self-funneling flexible container 112 may comprise any one or more patterns 802, 804, 806, 808, any other pattern, or any combination thereof.

Figure 10:
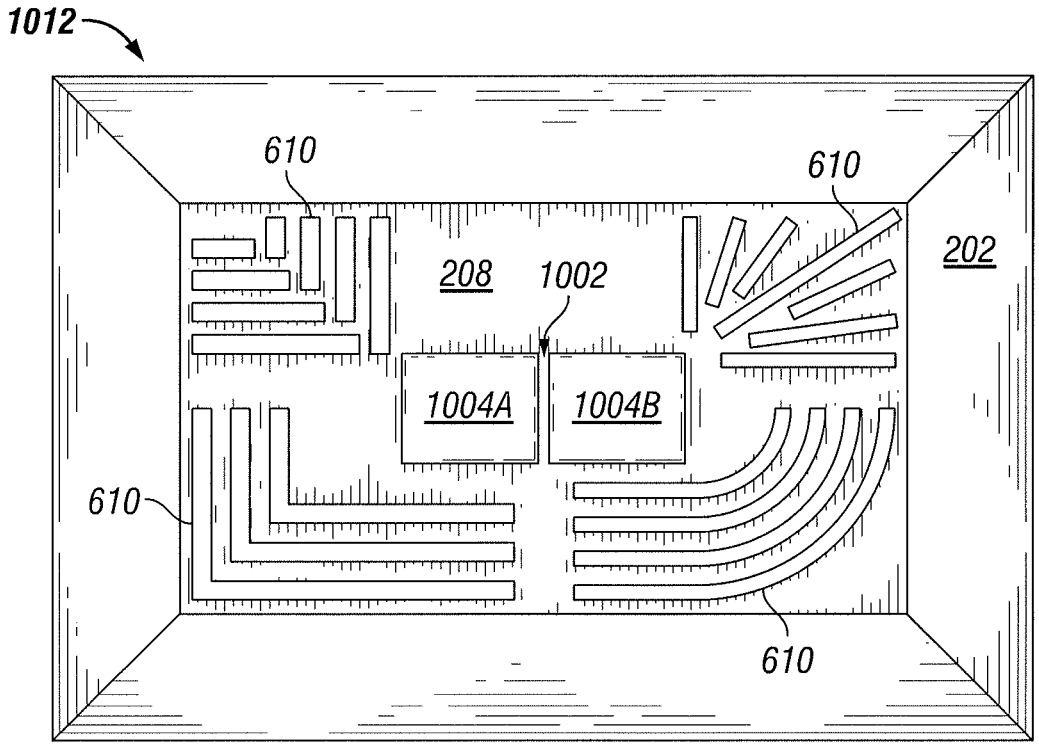
FIG. 10 is an isometric drawing of a partitionable self-funneling flexible container, according to one or more aspects of the present disclosure.

FIG. 10 illustrates an isometric view of a partitionable self-funneling flexible container 1012. Self-funneling flexible container 1012 may be similar to self-funneling flexible container 112 except that self-funneling flexible container 1012 comprises a partition 1002 disposed or positioned within the self-funneling flexible container 1012 to partition two or more portions of the self-funneling flexible container 1012. For example, a partition 1002 may be disposed or positioned between a bottom surface 208 and a top portion 214 such that partition 1002 separates two or more materials 102. That is, a first material may be stored in a first portion 1004A and second material may be stored in a second portion 1004B of the self-funneling flexible container 1012. Each portion 1004A and 1004B may form modified chute 720. For example, a modified chute 720 may comprise three sloped sides with the fourth side comprising the partition 1002.

In one or more embodiments, a self-funneling flexible material container system at a hydrocarbon well services or operation site comprising a self-funneling flexible container, wherein the self-funneling flexible container comprises one or more bands disposed about a bottom of the self-funneling flexible container, and wherein each of the one or more bands has an elasticity, a frame coupled to the self-funneling flexible container, wherein the self-funneling flexible container transitions to an expanded position when a material is flowed into the self-funneling flexible container, and wherein the self-funneling flexible container transitions to a contracted position when the material is discharged from the self-funneling flexible container and wherein the bottom forms a chute when transitioned to the contracted position. In one or more embodiments the self-funneling flexible container comprises one or more straps coupled to the frame. In one or more embodiments, the one or more straps circumnavigate the self-funneling flexible material container. In one or more embodiments, the frame is a support structure, wherein the support structure couples the self-funneling flexible material container to a hoisting mechanism. In one or more embodiments, the one or more bands form at least one of an L-shaped, a radiating line pattern, an inverted L-shaped pattern and a curved pattern. In one or more embodiments, the one or more bands extend at least partially on at least one side of the self-funneling flexible container. In one or more embodiments, the self-funneling flexible container comprises a gate disposed at the bottom, wherein the material is discharged through the gate. In one or more embodiments, the self-funneling flexible container is partitionable.

In one or more embodiments, a self-funneling flexible container comprises a top portion, a bottom, a plurality of sides coupled to the top portion and the bottom, one or more bands disposed about the bottom, wherein each of the one or more bands has an elasticity, wherein the self-funneling flexible container transitions to an expanded when a material is flowed into the self-funneling flexible container, and wherein the self-funneling flexible container transitions to a contracted position when the material is flowed out of the self-funneling flexible container and wherein the bottom forms a chute when transitioned to the contracted position. In one or more embodiments, the self-funneling flexible container further comprises a frame coupled to at least the top portion. In one or more embodiments, the self-funneling flexible container further comprises one or more straps. In one or more embodiments, the self-funneling flexible container further comprises one or more fasteners that coupled the one or more straps to the self-funneling flexible container. In one or more embodiments, the one or more straps circumnavigate the self-funneling flexible container. In one or more embodiments, the one or more straps couple to a frame. In one or more embodiments, the one or more bands extend at least partially on at least one side of the plurality of sides. In one or more embodiments, the one or more bands form at least one of an L-shaped, a radiating line pattern, an inverted L-shaped pattern and a curved pattern. In one or more embodiments, the self-funneling flexible container comprises a gate disposed at the bottom, wherein the material is discharged through the gate.

In one or more embodiments, a method for discharging a material using a self-funneling flexible container comprises opening a gate disposed in a bottom of the self-funneling flexible container, discharging the material through the gate, transitioning one or more bands disposed on the bottom of the self-funneling flexible container to a contracted position as the material is discharged, wherein each of the one or more bands are elastic and forming a chute by the bottom as the one or more bands transition to the contracted position. In one or more embodiments, the method further comprises coupling the self-funneling flexible container to a support structure using one or more straps secured to the self-funneling flexible container. In one or more embodiments, the method further comprises hoisting the self-funneling flexible container to a height, wherein the hoisting comprises coupling the support structure to a hoisting mechanism. In one or more embodiments, the method further comprises flowing the material into the self-funneling flexible container, wherein flowing the material transitions the one or more bands from a contracted position to an expanded position.

Although the present disclosure and its advantages have been described in detail, it should be understood that various changes, substitutions and alterations can be made herein without departing from the spirit and scope of the disclosure as defined by the following claims.

What is claimed is:

1. A self-funneling flexible material container system at a hydrocarbon well services or operation site, comprising:

a self-funneling flexible container, wherein the self-funneling flexible container comprises one or more bands disposed on a bottom of the self-funneling flexible container, and wherein each of the one or more bands has an elasticity;

a frame coupled to the self-funneling flexible container;

wherein the self-funneling flexible container transitions to an expanded position when a material is flowed into the self-funneling flexible container, and wherein the self-funneling flexible container transitions to a contracted position when the material is discharged from the self-funneling flexible container;

wherein the one or more bands form at least one pattern selected from the group consisting of an L-shaped pattern, an inverted L-shaped pattern, and a curved pattern; and wherein the bottom forms a chute when transitioned to the contracted position.

2. The self-funneling flexible material container system of claim 1, wherein the self-funneling flexible container comprises one or more straps coupled to the frame.

3. The self-funneling flexible material container system of claim 2, wherein the one or more straps circumnavigate the self-funneling flexible material container.

4. The self-funneling flexible material container system of claim 1, wherein the frame is a support structure, wherein the support structure couples the self-funneling flexible material container to a hoisting mechanism.

5. The self-funneling flexible container system of claim 1, wherein the one or more bands extend at least partially on at least one side of the self-funneling flexible container.

6. The self-funneling flexible container system of claim 1, wherein the self-funneling flexible container comprises a gate disposed at the bottom, wherein the material is discharged through the gate.

7. The self-funneling flexible container system of claim 1, wherein the self-funneling flexible container is partitionable.

8. A self-funneling flexible container, comprising:

a top portion;

a bottom surface;

a plurality of sides coupled to and extending between the top portion and the bottom surface;

one or more bands disposed on and extending along the bottom surface, wherein each of the one or more bands has an elasticity;

wherein the self-funneling flexible container transitions to an expanded position when a material is flowed into the self-funneling flexible container, and wherein the self-funneling flexible container transitions to a contracted position when the material is flowed out of the self-funneling flexible container;

wherein the bottom surface is disposed opposite the top portion in the extended position; and wherein the bottom forms a chute when transitioned to the contracted position.

9. The self-funneling flexible container of claim 8, further comprising at least one of a frame coupled to at least the top portion and one or more straps.

10. The self-funneling flexible container of claim 9, further comprising one or more fasteners that couple the one or more straps to the self-funneling flexible container.

11. The self-funneling flexible container of claim 9, wherein the one or more straps circumnavigate the self-funneling flexible container.

12. The self-funneling flexible container of claim 9, wherein the one or more straps couple to a frame.

13. The self-funneling flexible container of claim 8, wherein the one or more bands extend at least partially on at least one side of the plurality of sides.

14. The self-funneling flexible container of claim 8, wherein the one or more bands form at least one of an L-shaped pattern, an inverted L-shaped pattern, or a curved pattern.

15. The self-funneling flexible container of claim 14, wherein the one or more bands are disposed in one or more corner of the bottom surface.

16. The self-funneling flexible container of claim 8, wherein the self-funneling flexible container comprises a gate disposed at the bottom surface, wherein the material is discharged through the gate.

17. The self-funneling flexible container of claim 8, wherein the one or more bands form a radiating line pattern extending on the bottom surface when in the expanded position.

18. The self-funneling flexible container of claim 17, wherein the one or more bands are disposed in one or more corner of the bottom surface.

19. The self-funneling flexible container of claim 8, wherein the one or more bands extend from one or more corners and run along the bottom surface.

20. The self-funneling flexible container of claim 8, wherein the one or more bands form at least one pattern selected from the group consisting of an L-shaped pattern, a radiating line pattern, an inverted L-shaped pattern, and a curved pattern disposed in one or more corner of the bottom surface, and wherein the one or more bands are configured to elastically pull from the extended position to the contracted position along a plane of the bottom surface.

* * * * *